US006880642B1

(12) United States Patent
Garrett et al.

(10) Patent No.: US 6,880,642 B1
(45) Date of Patent: Apr. 19, 2005

(54) WELL ABANDONMENT PLUG

(76) Inventors: Jonathan Garrett, 745 Bocage La., Mandeville, LA (US) 70471; Joseph LeRouge, P.O. Box 92715, Lafayette, LA (US) 70509; Michael Taylor, 19378 S. Fitzmorris Rd., Covington, LA (US) 70435

( * ) Notice: Subject to any disclaimer, the term of this patent is extended or adjusted under 35 U.S.C. 154(b) by 0 days.

(21) Appl. No.: 10/365,373

(22) Filed: Feb. 12, 2003

Related U.S. Application Data

(60) Provisional application No. 60/428,428, filed on Nov. 21, 2002.

(51) Int. Cl.[7] ..... E21B 23/01; E21B 33/13; E21B 33/129

(52) U.S. Cl. ..... 166/382; 166/292; 166/117; 166/134; 166/211; 166/215

(58) Field of Search ..... 166/244.1, 285, 166/292, 381, 382, 387, 117, 118, 133, 134, 135, 188, 192, 206, 209, 210, 211, 214, 215, 216, 243

(56) References Cited

U.S. PATENT DOCUMENTS

| | | | | | |
|---|---|---|---|---|---|
| 2,230,712 | A | * | 2/1941 | Bendeler et al. | 166/123 |
| 3,434,538 | A | * | 3/1969 | Pumpelly et al. | 166/123 |
| 3,461,959 | A | * | 8/1969 | Conrad | 166/123 |
| 3,467,183 | A | * | 9/1969 | Young | 166/121 |
| 3,509,940 | A | * | 5/1970 | Young | 166/121 |
| 3,705,624 | A | * | 12/1972 | Pitts | 166/216 |
| 3,710,866 | A | * | 1/1973 | Pitts | 166/216 |
| 4,423,783 | A | * | 1/1984 | Haag | 166/382 |
| 4,427,063 | A | * | 1/1984 | Skinner | 166/134 |
| 4,429,746 | A | * | 2/1984 | Allard | 166/291 |
| 4,436,150 | A | * | 3/1984 | Barker | 166/131 |
| 4,518,037 | A | * | 5/1985 | Youngblood et al. | 166/125 |
| 4,568,708 | A | * | 2/1986 | Mason et al. | 523/130 |
| 4,586,567 | A | * | 5/1986 | Jameson | 166/121 |
| 4,693,309 | A | | 9/1987 | Caskey | |
| 4,736,796 | A | * | 4/1988 | Arnall et al. | 166/292 |
| 4,898,239 | A | * | 2/1990 | Rosenthal | 166/133 |
| 4,928,762 | A | * | 5/1990 | Mamke | 166/192 |
| 5,197,547 | A | | 3/1993 | Morgan | |
| 5,366,010 | A | * | 11/1994 | Zwart | 166/120 |
| 5,623,993 | A | * | 4/1997 | Van Buskirk et al. | 166/292 |
| 5,667,010 | A | * | 9/1997 | Boyd et al. | 166/292 |
| 5,697,449 | A | * | 12/1997 | Hennig et al. | 166/382 |
| 5,810,085 | A | * | 9/1998 | James et al. | 166/292 |
| 6,131,656 | A | | 10/2000 | Jani | |
| 6,666,275 | B1 | * | 12/2003 | Neal et al. | 166/386 |
| 6,715,543 | B1 | * | 4/2004 | Svindland | 166/192 |

OTHER PUBLICATIONS

Rocky Mountain Oilfield Testing Center, Project Results, "Petro–Plug Bentonite Plugging", Jan. 27, 1998.*
National Driller, "Well Abandonment Using Chipped Bentonite", Sep. 1, 2002.*
Arizona Department of Water Resources, "Well Abandonment Handbook", undated.*

* cited by examiner

*Primary Examiner*—David Bagnell
*Assistant Examiner*—Jennifer Gay
(74) *Attorney, Agent, or Firm*—Garvey, Smith, Nehrbass & Doody, L.L.C.; Seth M. Nehrbass; Charles C. Garvey, Jr.

(57) ABSTRACT

A method and apparatus of plugging and abandoning a well includes using a plug apparatus and installing bentonite elements in an oil well production casing having a bore. The plug apparatus is lowered into the production casing bore to a selected elevation using a slick line or the like. The apparatus has a tool body and slip dies that are movably mounted upon the tool body to move between extended and retracted positions. Afer the tool body is positioned at a selected location within the casing bore, tension is applied to the slick line to move the slip dies to an extended position wherein the slip dies engage the casing and secure the tool body in a desired location. The casing bore is then displaced with water above the tool body. Bentonite elements are then dumped into the water filled wellbore. The bentonite elements are allowed to swell to form a plug. The tool body can be retrieved from the casing bore if desired.

42 Claims, 8 Drawing Sheets

WELL ABANDONMENT PLUG

CROSS-REFERENCE TO RELATED APPLICATIONS

Priority of U.S. Provisional Patent Application Ser. No. 60/428,428, filed Nov. 21, 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to down hole oil well tools. More particularly, the present invention relates to a well abandonment plug apparatus that can be anchored at a selected position in a well and retrieved at a later time if desired.

2. General Background of the Invention

The present invention provides a plug that can be used in the Zonite (treated bentonite) abandonment technique of stripper wells. The design of the present invention is for a non-sealing plug to act as a base for the installation of the Zonite for the wells primarily in California and for a sealing plug for utilization of the wells primarily in New Mexico and Texas. The well plugs of the present invention are retrievable. The slickline abandonment plug of the present invention can be used with conventional slickline or wire rope running tools.

BRIEF SUMMARY OF THE INVENTION

Chevron Corporation (prior to its merger with Texaco in the fall of 2001) became involved with the development of an alternative abandonment technique for "stripper" wells in California. Stripper wells reference wells that require artificial lift to produce and have producing zones in which the formation pressure has become less than the original (virgin) pressure.

The technique developed involved the use of bentonite in the plugging process instead of cement. An integral part of the technique involves setting of a device inside the production casing that would act as a base for the Zonite installation.

The conventional method of abandoning stripper wells involves the use of cement and electric line set plugs. This process is relatively slow and expensive. Additionally, the cement slurry set in the wellbore has a high specific gravity and low viscosity. When a cement plug is set across perforations, because of its weight and viscosity, cement will fall through the perforations into the formation prior to setting up. Regulations require a plug of substantial height above the perforations (the "isolation plug"). Several attempts can be required to obtain a plug that will suffice. To counter this, an electric line set plug is sometimes set above the perforations to prevent the cement from dropping into the formation, adding significantly to the cost of the abandonment.

Regulations require a second plug to be set in the wellbore just below ground level, namely a "surface plug". Ensuring this plug stays in place also required an electric line plug.

The abandonment is completed by digging out around the wellhead, cutting off the casing strings (e.g. with a cutting torch) and backfilling the location. All plugs set must be tested either with pressure or by setting weight on the plug.

The abandonment technique that is being used and marketed involves the use of Zonite (e.g., a treated bentonite) rolled into balls approximately the size of a golf ball. After establishing a base for the installation of the Zonite (the plug of the present invention was designed to function as the base) the wellbore is displaced with fresh water and the Zonite balls are dumped in to the wellbore. The Zonite settles to the base, which is provided by the plug, and begins hydrating in the fresh water, thereby swelling up to form the isolation plug required by regulations. This plug is tested by tagging it with either slickline, the sand line or jointed pipe. The surface plug is set & tested in the same manner and the remainder of the plugging and abandonment (P&A) is concluded as with the conventional method.

The slick line abandonment plug of the present invention provides a design based upon the needs of the Zonite abandonment technique. The plug of the present invention was originally required to be a "base" for the Zonite installation. Problems encountered led to the additional requirement for the plug to be retrievable. In the effort to obtain regulatory approval in states other than California, the additional requirement of having sealing capability was added to plug. The plug of the present invention and its sealing variation have been designed and tested and meet these requirements.

The present invention provides a method and apparatus for plugging and abandoning a well. The present invention provides a method of installing bentonite elements in an oil well production casing having a bore. As part of the method, a tool body is lowered into the production casing bore to a selected elevation using a lifting and lowering device such as a slick line or wire line. The tool body has sockets that hold slip dies that are movably mounted in the sockets between extended and retracted positions.

At least some of the slip dies are moved to the extended position when the tool body reaches a selected elevation within the well. In the extended position, the slip dies engage the casing wall, anchoring the tool body to the selected elevational position.

The casing bore is displaced with water above the tool body. Bentonite elements are dumped into the water filled well bore. The bentonite elements are allowed to swell to form a plug. As part of the method, at least some of the slip dies are maintained in a retracted position when the tool body is lowered into the well.

A retainer can be used to hold the slip dies in the retracted position during lowering into the well. Shear pins can be part of the tool body and retainer. By lifting up on the slick line or wire line, these shear pins can be sheared to release the slips for enabling the tool dies to engage the casing.

In the preferred embodiment, springs can be used to urge the slick dies to the extended position.

As part of the method, the bentonite elements are preferably between about one and two inches in diameter.

The apparatus of the present invention provides a well abandonment apparatus that includes a tool body that is configured to be lowered into a production casing bore to a selected elevation. The tool body has upper and lower end portions.

A plurality of slip dies are attached to the tool body at sockets provided on the tool body. The sockets can be tubular passages that preferably form an acute angle with the central longitudinal axis of the tool body. Each slip is movable between a retracted and an extended position. The slip dies move to the extended position to engage the casing and anchor the tool body at a selection elevation within the well. Bentonite elements can be provided that are placed in the well above the tool body. These bentonite elements swell when contacted with the water enabling a plug to be formed above the tool body.

A running tool can be provided that holds the upper slip dies in the retracted position when the tool body is lowered into the well bore.

A slip activating means can be provided for moving the slip dies while the tool body is in the well bore to the extended position. This slip activating means can be, for example, shear pins that are sheared when the slick line is pulled in a upward direction. In such a situation, the lower slip dies are already extended when running to the well in a downward direction. In that direction, the slip dies do not bite into the well casing wall because the direction of travel urges them to retract back into their sockets. However, when the direction of travel the tool body is attempted to reverse by pulling up on the slick line or wire line, the lower slips engage the casing wall and hold the tool body at a selected position. Continued upward tension applied to the slick line or wire line causes shear pins to shear, separating the retainer from the tool body enabling the upper slips to expand to the extended position and engage the casing wall. In this position, the tool body is anchored so that it will not travel in either direction until it is time to be retrieved.

The tool body of the present invention can be retrieved. In the preferred embodiment, retainers are provided that hold the slips in a maximum extended position. However, when sufficient upward tension is applied to the wire line or slick line, a lower opening or recess provided at the lower end portion of the tool body enables a slight deformation inwardly of the lower end portion of the tool body so that the slips can move downwardly and cut the retainer. The retainer can be on o-ring, for example. The lower slips (and their springs) then fall into the well bore, separating from the tool body so that it can be retrieved.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
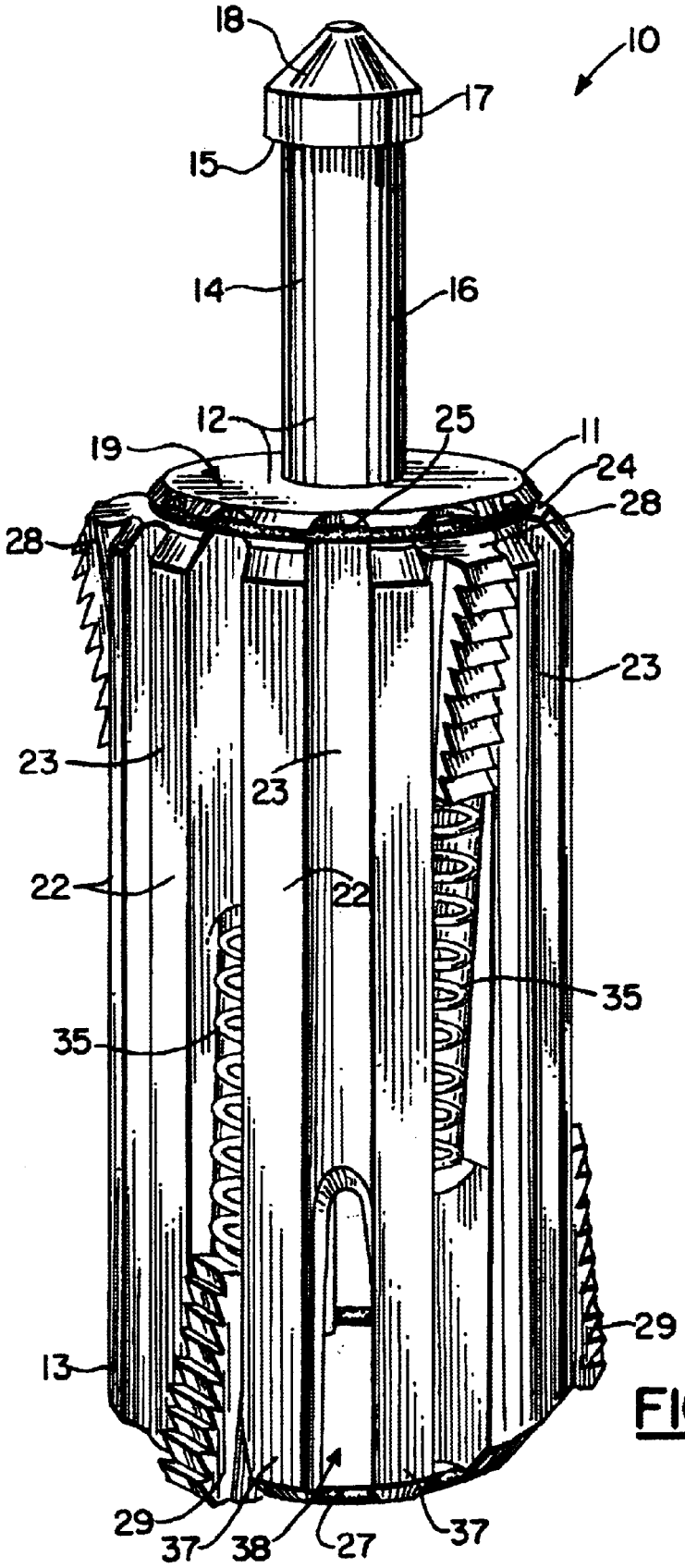
FIG. 1 is a perspective view of the preferred embodiment of the apparatus of the present invention.

FIGS. 1, 5–6, 8 and 9–10 show the preferred embodiment of the apparatus 10 of the present invention. Well plug apparatus 10 provides a plug body 11 having upper end portion 12 and lower end portion 13. A neck fitting 14 is attached to upper end 12 at socket 20. Socket 20 provides internal threads that engage the externally threaded section 21 of neck fitting 14.

Neck fitting 14 has a transverse annular shoulder 15 with larger diameter cylindrical section 17 above it and smaller diameter cylindrical section 16 below it. Conical section 18 can be provided above cylindrical section 17. Upper end portion 12 of plug body 11 has a transverse surface 19 that communicates with socket 20.

Figure 2:
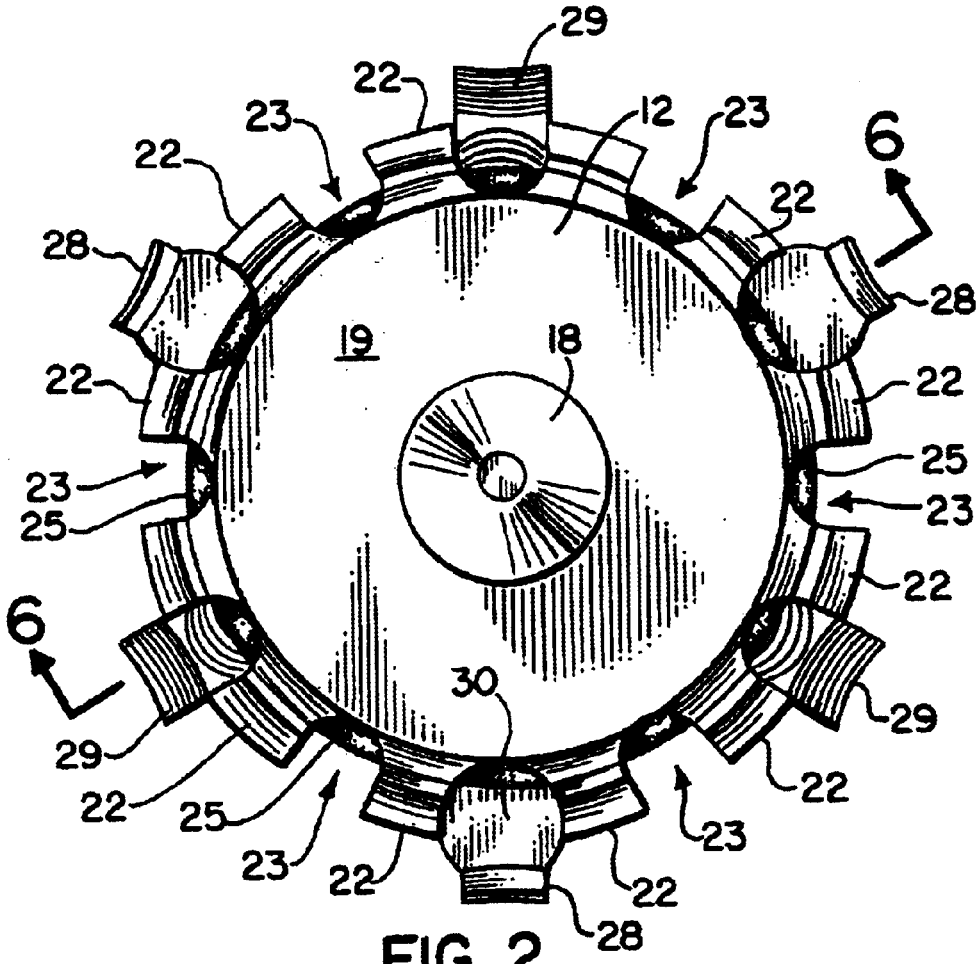
FIG. 2 is a top view of the preferred embodiment of the apparatus of the present invention.
Figure 3:
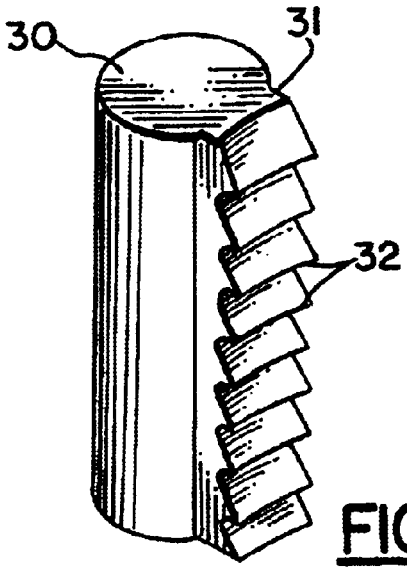
FIG. 3 is a fragmentary view of the preferred embodiment of the apparatus of the present invention showing one of the slip portions.
Figure 4:
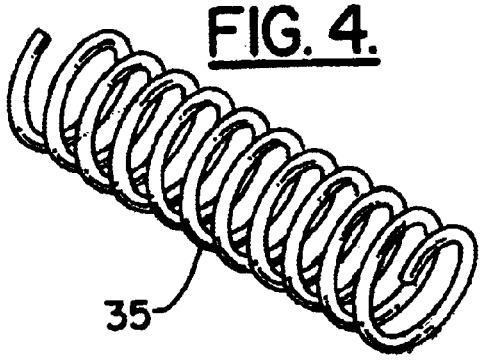
FIG. 4 is fragmentary view of the preferred embodiment of the apparatus of the present invention showing the spring portion.
Figure 5:
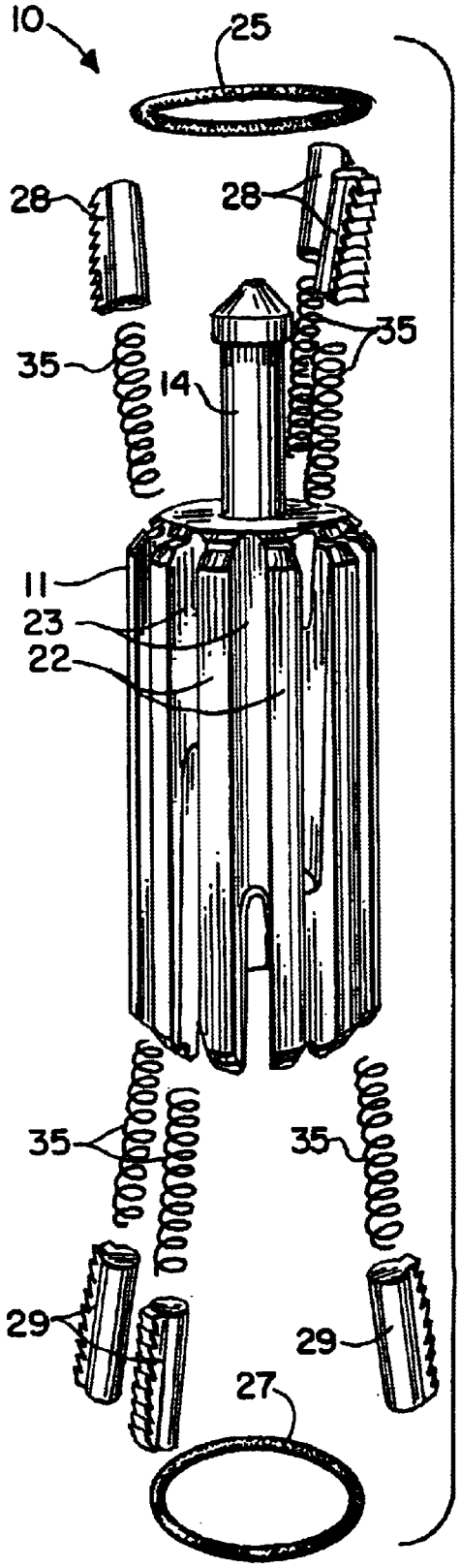
FIG. 5 is an exploded perspective view of the preferred embodiment of the apparatus of the present invention.

Plug body 11 has a plurality of ribs 22 with a plurality of grooves 23 spaced between the ribs 22. Each of the ribs 22 is longitudinally extending. The ribs 22 are circumferentially spaced and extend radially as shown in the top view of FIG. 2. Every other one of the grooves 23 communicates with a slip socket 33 for receiving one of the slip dies 28 or 29. In the preferred embodiment, there are three upper slip dies 28 and three lower slip dies 29. Each of the slip sockets 33 forms on an angle (see FIGS. 6 and 8) with the central longitudinal axis 55 of the plug body 11 and neck fitting 14. The slips are movable between an extended position that is shown in FIG. 6 and a retracted position that is shown for the upper slip 28 in FIG. 8.

Figure 10:
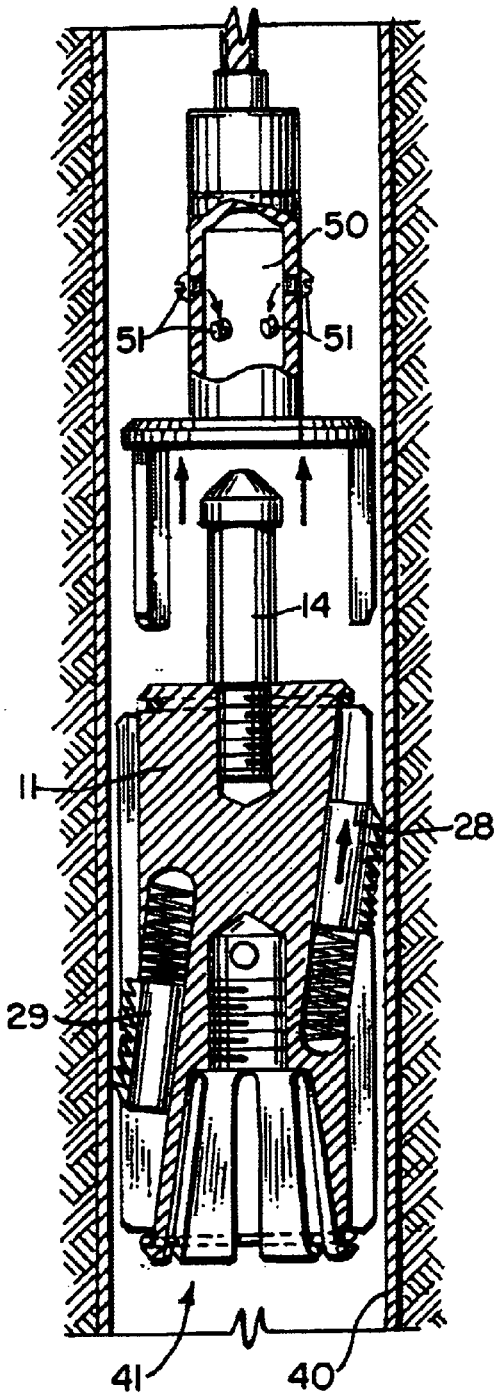
FIG. 10 is a sectional elevation view of the preferred embodiment of the apparatus of the present invention showing deployment of the apparatus at a selected position within a wellbore.

Springs 35 are contained within each of the slip sockets 33. The springs 35 urge each of the slips 28 or 29 to the extended position shown in FIG. 6. When in the position of FIG. 6, the slips 28, 29 prevent movement of the plug body 11 in either direction when the apparatus 10 is contained in a well. In FIG. 10, the upper slips 28 and the lower slips 29 are urged by springs 35 to bite into the casing by engaging the well casing internal wall surface 40.

Figure 6:
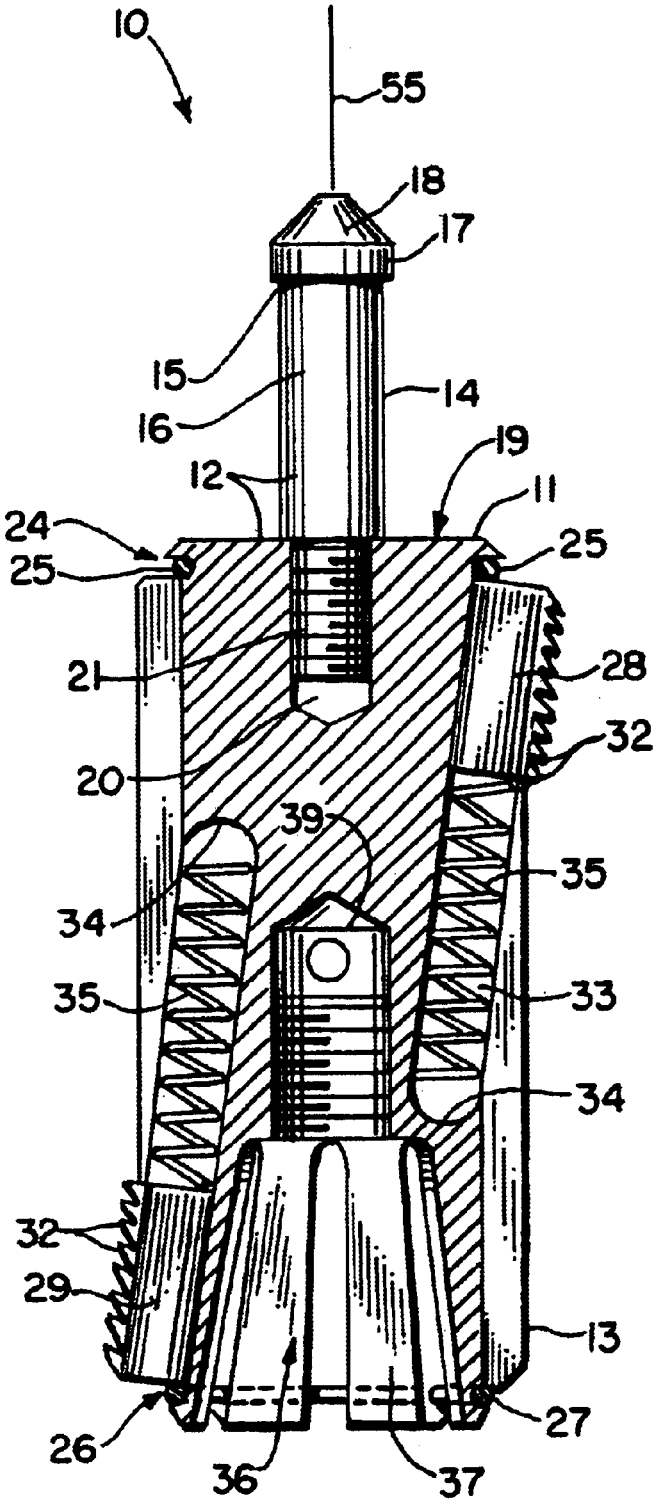
FIG. 6 is a sectional elevation view of the preferred embodiment of the apparatus of the present invention showing the slips in an extended, gripping position.
Figure 7:
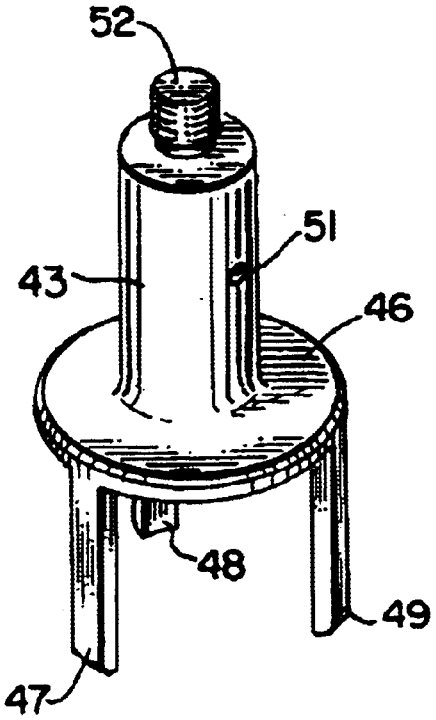
FIG. 7 is a partial perspective view of the preferred embodiment of the apparatus of the present invention showing the slip retainer.
Figure 8:
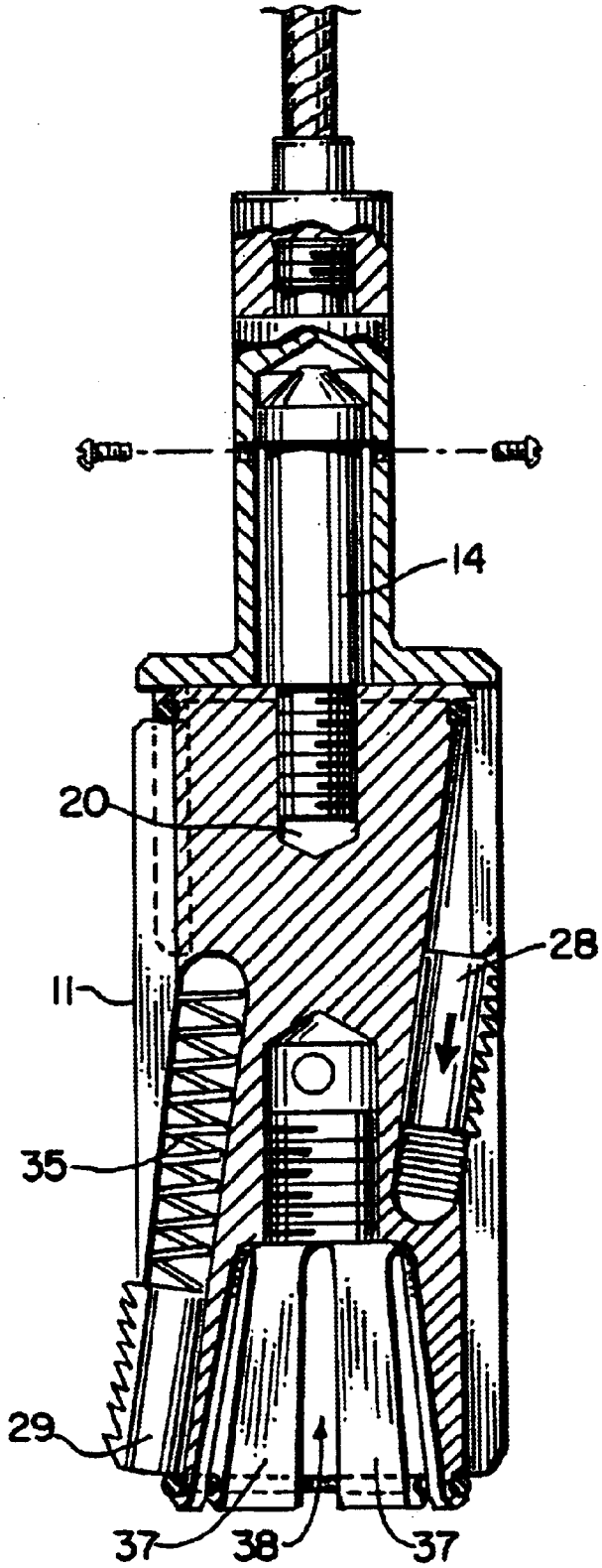
FIG. 8 is a sectional elevation view of the preferred embodiment of the apparatus of the present invention showing the upper slips in a retracted, running position.
Figure 9:
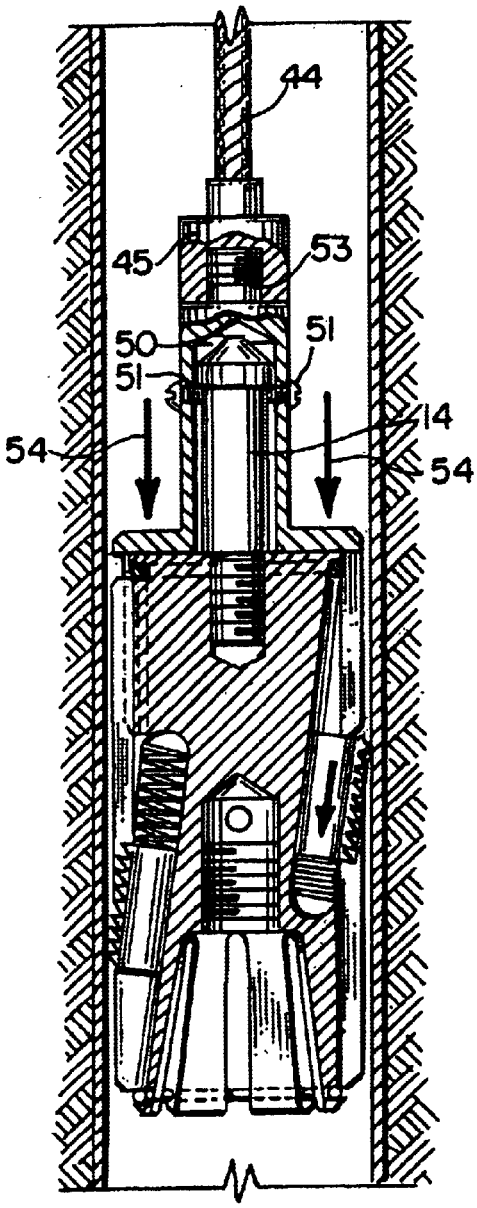
FIG. 9 is a sectional elevation view showing the preferred embodiment of the apparatus of the present invention positioned inside a wellbore during insertion into the well.

When the slips 28 or 29 are in the extended position of FIG. 6, upper 25 and lower 27 O-rings act as stops to prevent the slips 28 or 29 from being pushed completely out of the slip sockets 33 by the springs 35. The springs 35 engage a slip 28 or 29 at one end portion of the spring 35 and at the other end portion of the spring 35 engage a closed end 34 of the slip socket 33.

The plug body 11 can be sized and shaped to run inside casing and tubing in sizes ranging for example from 2-⅜"

tubing to 13-⅜" casing. The plug tool 10 can be designed as "one size fits all" for each size (OD—outside diameter) of tubing or casing. Plug body 11 can be machined from bar stock. After machining the body 11, springs 35, slip dies 28, 29, shear pins 51 and landing pin or fishing neck 14 are assembled to the tool body 11.

The tool 10 can be run into a wellbore 41 on slick line or wire rope 44. As it is run into the well, slip dies 28, 29 are recessed into radial grooves 23 and slip sockets 33 in the plug body 11 (see FIGS. 8–9). The upper slips 28 are recessed into sockets 33 using retainer 43. The lower slips 29 are simply urged into their sockets 33 because the tool body 11 is traveling in the direction of arrows 54, wherein friction with wall surface 40 pushes lower slips 29 into their sockets 33. Upon reaching the desired depth, the tool 10 is set by merely pulling up on the wire rope 44 and tool body 11 at neck fitting 14 thereby shearing the shear pins 51 to enable removal of retainer 43 and allowing the slip dies 28 to engage the well casing wall 40.

The plug 10 can be retrieved at a later time by latching the fishing neck 14 with a commercially available retrieving tool 60 or overshot (which can be run on a slick line, wire rope 44 or jointed pipe) and pulling up on the tool 10 until the lower slips 29 cut lower o-ring 27, releasing the lower slips 29 (see FIG. 12). The plug body 11 can then be pulled from the wellbore 41.

The plug body 11 can be manufactured of steel, aluminum or plastic. A steel version can be machined, as with the aluminum, or forged, or a plastic version can be molded.

This landing pin or neck 14 has two primary functions. A first function is to retain the running tool body 11 at annular shoulder 15 parallel to the nose of the landing pin 14 during insertion (see FIGS. 9–10). The shear pins (or screws) 51 can be part of the landing pin or neck 14.

A threaded portion 21 on the landing pin 14 attaches to the plug body 11 at internal threads in socket 20 to form a threaded connection. Threads at 20 on the running tool body 11 are right hand threads (which means screwing the male threads to the female threads in a clockwise manner to attach).

Figure 11:
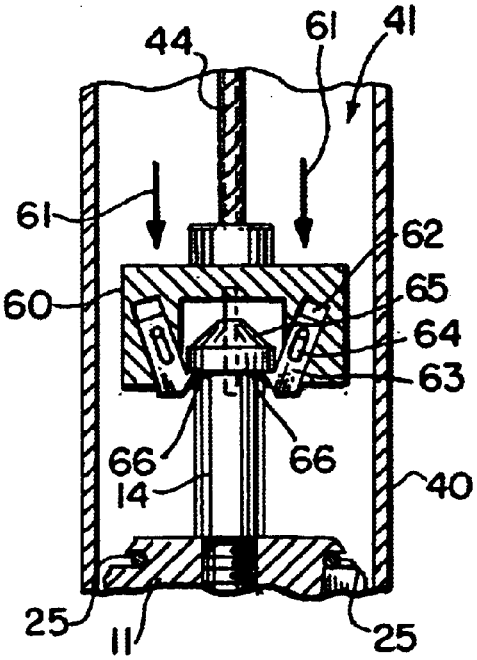
FIG. 11 is a partial sectional elevation view of the preferred embodiment of the apparatus of the present invention illustrating retrieval of the tool body.
Figure 12:
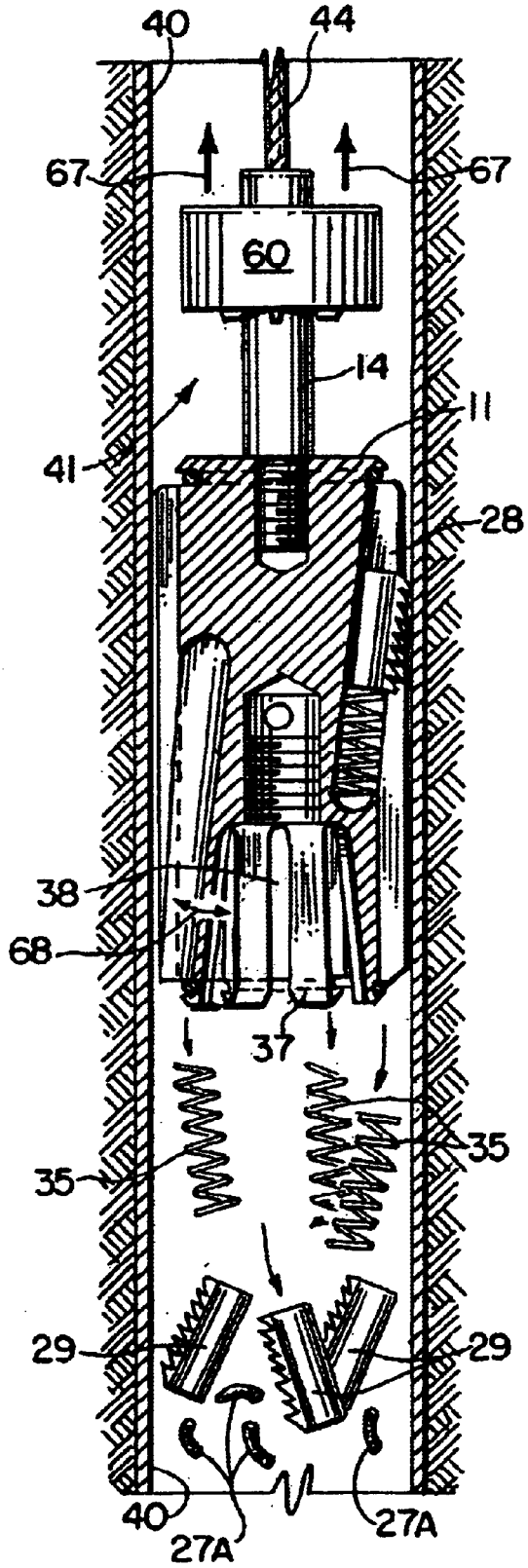
FIG. 12 is a another sectional elevation view of the preferred embodiment of the apparatus of the present invention illustrating retrieval of the tool body.

A second function of landing pin 14 is for retrieval purposes see FIGS. 11–12. Common wireline retrieval tools can be used to attach to landing pin 14. Basically, landing pin 14 is a standard receptacle used in the oil industry (a standard connector).

The landing pin 14 is generally referred to as the "fishing neck" in generic oilfield terminology. A "landing tool" assembly is generically known as the "running tool". A retrieval tool is called the "pulling tool".

The primary purpose of the plug body 11 is to facilitate the functions of the slip dies 28, 29 and the springs 35. Radial grooves or splines 23 allow fluid to bypass the outside diameter of the plug body 11. Incorporated within three of the grooves 23 on each side are slip sockets 33 used to hold the slip dies 28, 29 and springs 35. There can be a total of twelve (12) grooves 23 in the plug body 11. Six of the grooves 23 are utilized by the slip dies 28, 29 and springs 35.

The upper end 12 of the plug body 11 has female threads at socket 20 which the landing pin 14 attaches to at a threaded connection. Female threads in socket 20 can be concentric with the outside diameter of the body 11.

A bottom opening, receptacle, or socket 36 is provided with a threaded bore section 39 that can be used to facilitate (or attach) an optional sealing device. This tapered counter bore or socket 36,39 located at the bottom of the plug body 11 has two primary functions. Firstly, to give flexibility characteristics when retrieving the plug body 11. Fingers 37 and slots 38 are next to socket 36. Fingers 37 flex inwardly toward socket 36 when the tool body 11 is to be removed (see FIG. 12). Secondly, it can be used for an optional unidirectional seal assembly.

A mating plug assembly (not shown) conforms to the tapered counter bore 36,39 which in turn restricts the external slip die pockets 33 to flex inward. The slip dies 28, 29 retain the plug body 11 from moving or disengaging the plug body 11.

A perpendicular hole can be located on the outside diameter of the plug body and communicating with the outside of the plug body 11, and intersecting the threaded bore 36, 39. The purpose of this transverse or perpendicular bore is to allow differential pressure to inflate an optional seal assembly.

External grooves 24, 26 located respectively on opposite ends (upper 12 and lower 13) of the plug body 11 are to hold the O-rings 25, 27 respectively which retain the slip dies 28, 29 and springs 35.

The slip dies 28, 29 are designed with a round or cylindrical primary base 30 having circular ends in order to fit within the grooves 23 of the plug body 11. Incorporated within the round base 30 of the slip die is a rectangular boss 31 in which machined teeth 32 are located. The teeth 32 are designed to bite/grasp the internal surface 40 of the casing, which in turn, retains the plug body 11 within the casing. The greater the force that is applied to the slip dies 28, 29, the tighter the grip or teeth engagement with the casing inner surface 40.

The plug body 11 requires opposing slip dies 28, 29 positioned on each side of body 11. When all slip dies 28, 29 are engaged, the plug body 11 is not allowed to move in either direction. In the retrieval process this only applies in one direction.

The bottom end 13 of the plug body 11 is designed to bend or collapse under the excessive force which will in turn allow the lower bottom slip dies 29 to shear the bottom O-ring 27 (see FIG. 12) and become non-functional and therefore drop down into the well bore 41.

The teeth 32, which are the integral part of the slip die 13 are designed to be harder than all grades of casing. This design is to ensure positive engagement (grip) with the casing wall casing 40.

The primary purpose of the springs 35 is to ensure the engagement of the slip dies 28, 29. The springs 35 on the upper end portion 12 of the plug body 11 are compressed with slip retainer 43 of the running tool 60 and allow the upper slip dies 28 to retract within the plug body (see FIGS. 8 and 9). When the plug body 11 is located within the desired casing depth and the running tool 43 is removed (see FIG. 10), appendages 47, 48, and 49 of slip retainer 43 move out of splines 23 and allow the top springs 35 to force the upper slip dies 28 against the casing bore.

The bottom springs 35 are used to maintain lower slip dies 29 engagement of the casing bore while running the plug tool assembly 10 down hole. The springs 35 provide constant pressure on the slip dies 28, 29 which provides the slip dies 28, 29 to grip or engage the casing bore when moving upward in the opposite direction. The springs 35 also assist in the retrieval process of the plug body 11 by discarding the lower slip dies 29 which allows the plug body to release.

The primary function of the O-rings 25, 27 is to retain the slip dies 28, 29 and springs 35. The O-rings 25, 27 have sufficient shear characteristics that allow the bottom slip die 29 and spring assembly 35 to separate from (collapse) the plug body 11 upon retrieval (See FIG. 12).

Figure 13:
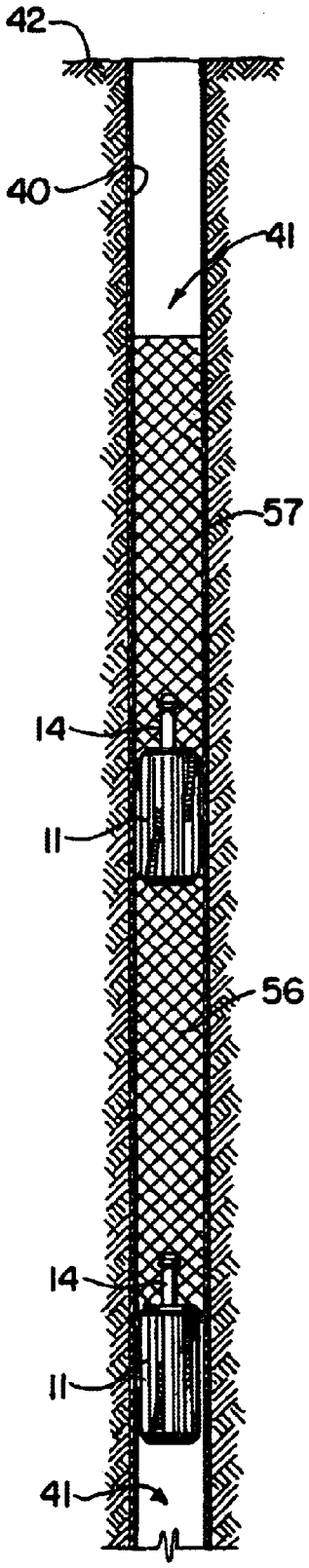
FIG. 13 is a schematic sectional elevation view showing deployment of the apparatus of the present invention in a well as part of a well abandonment.

FIG. 13 shows the apparatus 10 of the present invention in relation to a well bore 41 having a casing lining, providing casing surface 40 and showing the earth's surface 42 above the well bore 41.

In FIG. 13, there are two plug bodies 11 disposed at differing elevations within the well bore 41. A first section of bentonite 56 is shown in between two plug bodies 11 in FIG. 13. This first, lower section 56 of bentonite is placed in the well after the first plug body 11 has been lowered and set using the procedure shown in FIGS. 9 and 10 and described herein. After the first bentonite section 56 has been added to the well bore 41, a second plug body 11 is placed above the first bentonite section 56 as shown in FIG. 13. A second bentonite section 57 is then added to the well bore 41 above the upper plug body 11 as shown in FIG. 13. Thus, two plug bodies 11 and two bentonite sections 56, 57 can be used to fully and completely plug and abandon the well bore 41.

FIGS. 11 and 12 show removal of a plug body 11 using wire line or slick line 44 in combination with a retrieval tool 60. The retrieval tool 60 is lowered in the direction of arrows 61 in FIG. 11. The retrieval tool 60 can provide a plurality of lifting members 63, each disposed in an angle to socket 62. Pins 65 within the sockets 62 engage slots 64 of the lifting member 63 as shown. This enables the lifting member 63 to be retracted into the sockets 62 so that they can retract when engaging the larger diameter portion 17 of neck fitting 14. Each of the lifting members 63 provides a shoulder 66 that engages the annular shoulder 15 of neck fitting 14 as shown in FIG. 11. For removal of the tool body 11, the retrieval tool 60 is pulled upwardly in the direction of arrows 67 in FIG. 12 using a lifting device (e.g., crane, boom, winch) and a slick line or wire line 44. When this occurs, the fingers 37 that are spaced apart by slots 38 flex as schematically illustrated by arrow 68 in FIG. 12. This flexing enables the slips 29 to shear o-ring 27, breaking it into o-ring sections 27A that fall into the well bore. Once the lower slips 29 have fallen from their respective sockets 33, the tool body 11 can be retrieved as shown in FIG. 12.

The present invention is not limited to any specific casing size (such as the 5.5" and 7"). It can be manufactured for any casing size such as: 5.5", 7", 7 ⅝", 9 ⅝", 10 ¾", 13 ⅜" etc. Larger plug 10 sizes may require more slip sockets and grooves.

PARTS LIST

The following is a list of parts and materials suitable for use in the present invention:

10 well plug apparatus
11 plug body
12 upper end portion
13 lower end portion
14 neck fitting
15 annular shoulder
16 cylindrical section
17 cylindrical section
18 conical section
19 transverse surface
20 socket
21 externally threaded section
22 rib
23 groove or spline
24 upper circumferential groove
25 o-ring
26 lower circumferential groove
27 o-ring
27A cut o-ring sections
28 upper slip die
29 lower slip die
30 cylindrical base
31 rectangular boss
32 teeth
33 slip socket
34 closed end
35 spring
36 socket
37 finger
38 slot
39 internally threaded section
40 well casing internal wall surfaces
41 well bore
42 earth surface
43 slip retainer
44 wire rope
45 coupling
46 flange
47 appendage
48 appendage
49 appendage
50 socket
51 shear pin
52 externally threaded pin
53 internally threaded socket
54 arrow
55 central longitudinal axis
56 first bentonite section
57 second bentonite section
60 retrieval tool
61 arrow
62 angled socket
63 lifting member
64 slot
65 pin
66 shoulder
67 arrow
68 arrow The foregoing embodiments are presented by way of example only; the scope of the present invention is to be limited only by the following claims.

What is claimed is:

1. A method of installing bentonite elements in an oil well production casing having a bore, comprising the steps of:

a) lowering a tool body into the production casing bore to a selected elevation using a slick line, the tool body having sockets and slip dies that are movably mounted in the sockets between extended and retracted positions, the tool body including a splined section that enables fluid to flow past the tool body;

b) moving at least some of the slip dies to the extended position wherein the slip dies engage the casing;

c) displacing the casing bore with water above the tool body;

d) dumping bentonite elements into the water filled well bore;

e) allowing the bentonite elements to swell to form a plug; and f) wherein in step "a" at least some of the slip dies are in the retracted position.

2. The method of claim 1 wherein in step "b" shear pins carried by the tool body are sheared, enabling the too slip dies to engage the casing.

3. The method of claim 1 wherein the bentonite elements are about 1–2 inches in diameter.

4. The method of claim 1 wherein the bentonite elements are between about 1 and 2 inches in diameter.

5. The method of claim 1 wherein the casing bore is between about2⅝" up to 36" or more inches internal diameter.

6. The method of claim 1, wherein in step "a" a retainer holds at least some of the slips in the retracted position.

7. The method of claim 1 wherein the tool body has an upper landing pin at the top of the tool body.

8. The method of claim 1 wherein the tool body dies are spring loaded in steps "a" and "b".

9. The method of claim 1 wherein, for a given outside diameter of casing, the tool body is sized to fit any casing bore of any diameter.

10. The method of claim 1, wherein step b) includes pulling upward on a slip retainer, which includes appendages which fit into splines of the splined section of the tool body to retain at least some of the slip dies in a retracted position while the tool body is lowered into a casing to a desired plug location, to pull the appendages out of contact with at least some of the slip dies.

11. A method of installing bentonite elements in an oil well production casing having a wall and a bore, comprising the steps of:

a) lowering a tool body into the production casing bore to a selected elevation, the tool body including a splined section and the tool body carrying upper and lower sets of slip dies;

b) moving the upper slip dies to the extended position wherein the slip dies engage the casing wall;

c) displacing at least part of the casing bore with water above the tool body;

d) placing a plurality of bentonite elements into the water filled part of the well bore;

e) allowing the bentonite elements to swell to form a plug; and f) wherein in step "a" the slip dies are in the retracted position.

12. The method of claim 11 wherein in step "b" shear pins carried by the tool body are sheared, enabling the slip dies to engage the casing.

13. The method of claim 11 wherein the bentonite elements are about 1–2 inches in diameter.

14. The method of claim 11 wherein the bentonite elements are between about 1 and 2 inches in diameter.

15. The method of claim 11 wherein the casing bore is between about 1 and 13 inches internal diameter.

16. The method of claim 11 wherein the tool body has an upper landing pin at the top of the tool body.

17. The method of claim 11 wherein slip dies are spring loaded in step "b".

18. The method of claim 11 wherein the tool body is retrievable.

19. The method of claim 18 further comprising retrieving the tool body with a slick line.

20. The method of claim 11 wherein the tool body has a central longitudinal axis and the slip dies form an acute angle with said central longitudinal axis.

21. The method of claim 11, wherein step b) includes pulling upward on a slip retainer, which includes appendages which fit into splines of the splined section of the tool body to retain the upper slip dies in a retracted position while the tool body is lowered into a casing to a desired plug location, to pull the appendages out of contact with the upper slip dies.

22. An apparatus for installing bentonite elements in an oil well production casing having a bore, comprising:

a) a tool body that is configured to be lowered into the production casing bore to a selected elevation using a slick line, the tool body having a splined section;

b) the tool body having a plurality of radially extending, circumferentially spaced grooves that enable fluid to flow between positions above and below the tool body;

c) slip dies that are movably mounted upon the tool body at the grooves wherein the slip dies are movable in between extended and retracted positions;

b) a landing pin for applying tension via slick line to the tool body and for moving the slip dies to the extended position wherein the slip dies engage the casing;

c) springs that urge the slip dies to engage the casing;

d) wherein the tool body has a central longitudinal axis and each slip die forms an acute angle with the central longitudinal axis.

23. The apparatus of claim 22 further comprising shear pins carried by the tool body that can be sheared for enabling the slip dies to engage move to the extended position and engage the casing.

24. The apparatus of claim 22 wherein the tool body includes a receptacle with a threaded bore section to attach a packing member below the splined section.

25. The apparatus of claim 24 wherein the tool body has an upper surface and the landing pin attaches to the upper surface of the tool body.

26. The apparatus of claim 22 further comprising bentonite elements that engage the plug body.

27. The apparatus of claim 22, further comprising a slip retainer which includes appendages which fit into splines of the splined section of the tool body to retain at least some of the slip dies in a retracted position while the tool body is lowered into a casing to a desired plug location.

28. A well abandonment system, comprising:

a) a tool body that is configured to be lowered into the production casing bore to a selected elevation, the tool body having upper and lower end portions, the tool body having a splined section;

b) a plurality of slip dies attached to the tool body, each movable between retracted and extended positions, wherein the slip dies engage the casing in the extended position;

c) means for urging the dies to move toward the extended position;

d) a plurality of bentonite elements placed into the well next to the tool body and that swell when contacted with water enabling a plug to be formed above the tool body;

f) a retainer that holds the slip dies in the retracted position when the tool body is lowered into a well bore; and g) slip activating means for moving the slip dies while the tool body is in the well bore, to the extended position.

29. The apparatus of claim 28 wherein shear pins carried by the tool body are provided that can be sheared for enabling the dies to engage the casing.

30. The apparatus of claim 28 wherein the bentonite elements are larger than about one half inches in diameter.

31. The apparatus of claim 28 wherein the tool body has a landing pin at the top of the tool body.

32. The apparatus of claim 28 wherein the dies are spring loaded.

33. The apparatus of claim 28 wherein the tool body is retrievable.

34. The method of claim 28 wherein the tool body has a central longitudinal axis and the slip dies form an acute angle with said central longitudinal axis.

35. The system of claim 28, wherein the retainer includes appendages which fit into splines of the splined section of the tool body to retain the upper slip dies in a retracted position while the tool body is lowered into a casing to a desired plug location.

36. An apparatus for installing bentonite elements in an oil well production casing having a casing wall and a bore, comprising:

a) a tool body that is configured to be lowered into the production casing bore to a selected elevation using a slick line, the tool body having a splined section;

b) the tool body having a plurality of radially extending, circumferentially spaced grooves that enable fluid to flow between positions above and below the tool body;

c) a plurality of slip dies that are movably mounted upon the tool body, wherein the slip dies are movable between extended and retracted positions, the slip dies including a first plurality of upper slip dies that have upper and lower end portions, the lower end portions being closer to the central longitudinal axis than the upper end portions, and a plurality of lower slip dies that have upper and lower end portions, the upper end portions being closer to the central longitudinal axis than the lower end portions;

b) a landing pin for applying tension to the tool body;

c) springs that urge the slip dies to engage the casing wall;

d) wherein the tool body has a central longitudinal axis and each slip die forms an acute angle with the central longitudinal axis.

37. The apparatus of claim 36 further comprising shear pins carried by the tool body that can be sheared for enabling the slip dies to engage move to the extended position and engage the casing.

38. The apparatus of claim 36 wherein, for a given outside diameter of casing, the tool body is sized to fit any casing bore of any diameter.

39. The apparatus of claim 36 wherein the tool body includes a receptacle with a threaded bore section to attach a packing member below the splined section.

40. The apparatus of claim 39 wherein the tool body has an upper surface and the landing pin attaches to the upper surface of the tool body.

41. The apparatus of claim 36 further comprising bentonite elements that engage the plug body.

42. The apparatus of claim 36, further comprising a slip retainer which includes appendages which fit into splines of the splined section of the tool body to retain the upper slip dies in a retracted position while the tool body is lowered into a casing to a desired plug location.

* * * * *